US007093550B2

(12) United States Patent
Williamson et al.

(10) Patent No.: US 7,093,550 B2
(45) Date of Patent: Aug. 22, 2006

(54) BARGE CONSTRUCTION AND FREIGHT HAULING SYSTEM

(75) Inventors: George Williamson, Seattle, WA (US); Bob Shrewsbury, Edmonds, WA (US); Alex McKallor, Seattle, WA (US)

(73) Assignee: Lynden Incorporated, Seattle, WA (US)

( * ) Notice: Subject to any disclaimer, the term of this patent is extended or adjusted under 35 U.S.C. 154(b) by 42 days.

(21) Appl. No.: 10/506,205

(22) PCT Filed: Mar. 12, 2003

(86) PCT No.: PCT/US03/08149

§ 371 (c)(1),
(2), (4) Date: Aug. 31, 2004

(87) PCT Pub. No.: WO2004/083030

PCT Pub. Date: Sep. 30, 2004

(65) Prior Publication Data

US 2005/0109255 A1 May 26, 2005

(51) Int. Cl.
*B63B 25/00* (2006.01)

(52) U.S. Cl. ..... 114/72

(58) Field of Classification Search ..... 114/72, 114/258

See application file for complete search history.

(56) References Cited

U.S. PATENT DOCUMENTS

| | | | | |
|---|---|---|---|---|
| 1,772,612 A | | 8/1930 | McDougall | |
| 2,672,840 A | * | 3/1954 | Sharp et al. | 114/70 |
| 2,853,968 A | | 9/1958 | McLean | |
| 3,591,023 A | | 7/1971 | Allen | |
| 3,828,710 A | | 8/1974 | Sause, Jr. | |
| 3,830,177 A | | 8/1974 | Nemec et al. | |
| 3,889,619 A | | 6/1975 | Glassmeyer | |
| 3,919,959 A | | 11/1975 | Nemec et al. | |
| 4,055,263 A | | 10/1977 | Freeman | |
| 4,111,145 A | | 9/1978 | Ohsaka | |
| 4,625,670 A | | 12/1986 | Igielska | |
| 5,215,026 A | | 6/1993 | Windelberg et al. | |
| 5,359,952 A | | 11/1994 | Klundt et al. | |

FOREIGN PATENT DOCUMENTS

| | | |
|---|---|---|
| GB | 2 040 831 A | 9/1980 |
| GB | 2040831 A | 9/1980 |
| JP | 60-166582 A | 8/1985 |
| JP | 61-175194 A | 8/1986 |
| SU | 1474-053 A | 4/1989 |
| SU | 1474053 A | 4/1989 |

* cited by examiner

*Primary Examiner*—Stephen Avila
(74) *Attorney, Agent, or Firm*—Christensen O'Connor Johnson Kindness PLLC

(57) ABSTRACT

A freight hauling vessel (10) has a deck (12) with sets of railroad tracks (14) for rail cars (64), enabling rail cars to be rolled onto and off of the deck. Upright rows of stanchions (18) support standardized freight containers (63) spanning betwe the rows and over the rail cars.

13 Claims, 7 Drawing Sheets

32
34
36
40
42
44
46
47
48
50
52
54
18
12
8

BARGE CONSTRUCTION AND FREIGHT HAULING SYSTEM

FIELD OF THE INVENTION

The present invention relates to the general field of freight hauling, and particularly to vessels adapted to transport roll-on, roll-off cargo such as rail cars.

BACKGROUND OF THE INVENTION

One known freight hauling system uses a barge having a flat deck and standard railroad tracks extending lengthwise of the deck. Rail cars are loaded onto and off of the barge at the origin and destination docks by ramps, usually connected to the stern. Depending on the number of rail cars to be carried, other wheeled or non-wheeled cargo can be placed on the deck.

SUMMARY OF THE INVENTION

The present invention uses a freight-hauling vessel having a deck adapted for wheeled cargo to be rolled on and rolled off the deck. More specifically, in a preferred embodiment, the deck of a barge has longitudinally extending railroad tracks for side-by-side rows of rail cars. The tracks can extend essentially the full length of the freight-carrying deck of the barge.

In accordance with the present invention, the barge is provided with a "rack" system for supporting standard freight containers above the rail cars. The rack system includes at least two longitudinally extending rows of stanchions straddling at least one, preferably two or three, sets of tracks with the space between the stanchion rows being open and unobstructed at the top. The upper ends of the stanchions carry foundation blocks spaced apart transversely and longitudinally of the vessel at the standard distances between fittings (usually corner fittings) of known freight containers. Stacking cones or twist locks are used to connect freight containers to the stanchions, and to connect upper tiers of freight containers stacked on lower tiers.

In a preferred embodiment, the rack system includes a row of stanchions along each outboard side of the vessel, and two inboard rows of stanchions toward the central portion of the vessel. The inboard stanchions are connected by cross-beams. A center grating walkway is supported on the cross-beams. The four rows divide the vessel into three side-by-side freight-hauling areas or zones. These zones include two outboard zones that are open and unobstructed at the top and an inboard "tunnel" zone having the central grating walkway at the top. Standard freight containers can be loaded so as to bridge across the outboard freight-hauling zones, with the lengths of the containers extending transversely of the vessel across multiple sets of tracks for rail cars. After placement of the containers, rolling stock, preferably rail cars, can be loaded underneath the containers in the outer zones and under the central grating in the center zone.

BRIEF DESCRIPTION OF THE DRAWINGS

The foregoing and additional aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
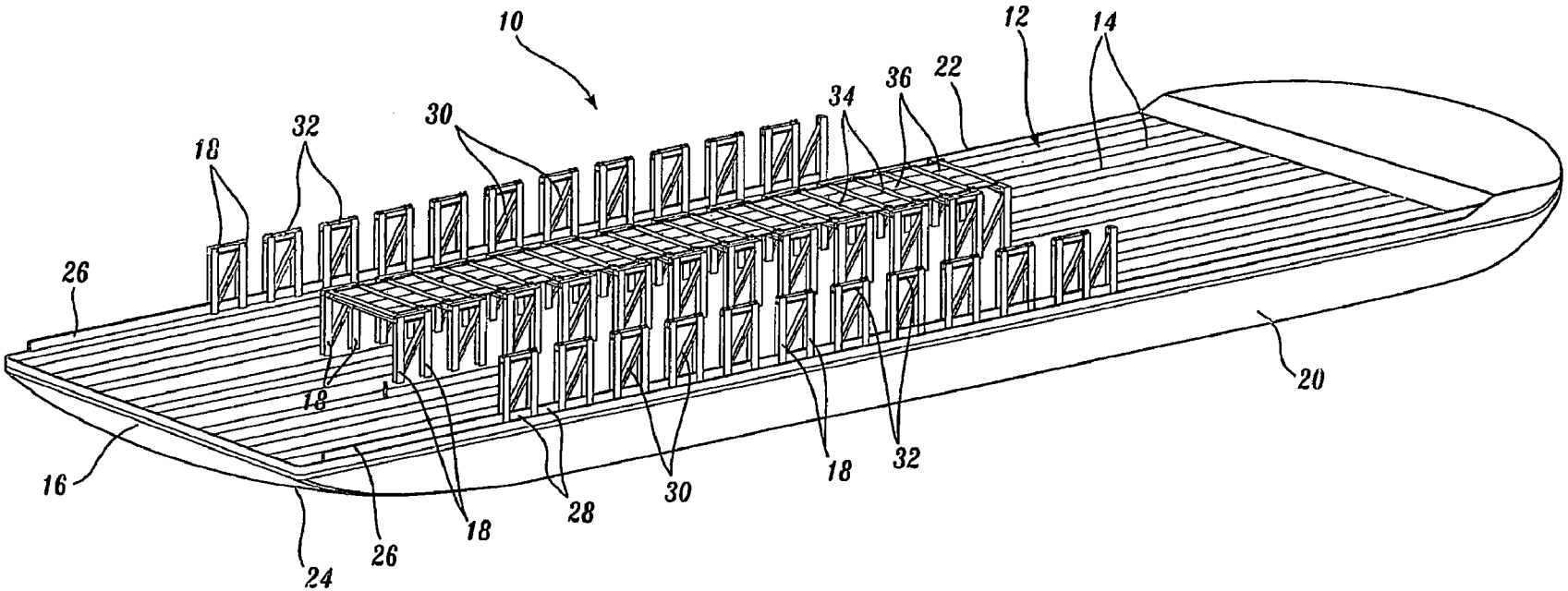
FIG. 1 is a diagrammatic top perspective of a barge construction in accordance with the present invention, with some detail of the construction deleted.

The present invention provides a freight-hauling vessel having a deck adapted for wheeled cargo to be rolled on and rolled off the deck, and a permanent rack system incorporated in the vessel for carrying non-wheeled freight above the wheeled cargo. In the preferred embodiment the wheeled cargo includes rail cars and the non-wheeled freight includes standard freight containers supported by the rack system above the rail cars.

With reference to FIGS. 1–4, barge 10 has a freight-carrying deck 12 with longitudinally sets of railroad tracks 14 that extend essentially the full length of the deck. As described in more detail below with reference to FIG. 10, rail cars can be loaded onto the deck from the stern 16 by an end ramp from a loading dock. The end ramp may have one or more sets of tracks, and the barge may be shifted transversely to provide access to its many sets of tracks.

In a representative construction, the barge may be approximately 420 feet (128 meters) long by 100 feet (30.5 meters) wide, equipped with 8 sets of tracks to provide approximately 3,200 feet (975 meters) of track on the deck. The maximum number of rail cars in a load will vary based on car length. For example, rail cars can be about 40 feet (12.2 meters) to 90 feet (27.4 meters) long. In known rail car barges, the number of cars accommodated also depends on the extent to which deck space is used or reserved for other cargo. The barge has a sturdy understructure of steel frame construction to support the sizable load carried by the deck. Preferably, all materials and workmanship conform to standards of the American Bureau of Shipping (ABS).

In accordance with the present invention, a permanent rack structure is incorporated in the barge to enable more cargo, and different types, to be hauled. Still referring to FIGS. 1–4, the rack system of the present invention includes a plurality of longitudinally extending, transversely spaced rows of stanchions 18. In the preferred embodiment, four rows of nearly identical stanchions are permanently affixed to and supported by the deck understructure which is reinforced to safely carry the considerable weight of the rack structure and the cargo it will support. One row of stanchions extends along one outboard side 20 of the barge, and another row extends along the other outboard side 22 of the barge. Two inboard rows of stanchions are provided, equidistant from the barge centerline. The stanchions of each of the four rows are aligned transversely of the barge with stanchions of each of the other rows. For example, in the illustrated embodiment, each row includes 23 stanchions spaced substantially uniformly lengthwise of the barge. Since the aft-most stanchions are aligned transversely of the barge, all other stanchions of each row are aligned with corresponding stanchions of the other rows. In the illustrated embodiment, the length of the rack structure is slightly less than one-half the length of the entire barge, with the rack structure being offset aftward from the center. The aft end of the rack structure is approximately aligned with the leading end of the barge stern rake 24.

Each row of stanchions 18 is of steel beam and girder construction, with the bottom end of each stanchion welded to the barge understructure and any necessary reinforcement. For installation of the outboard stanchion rows, the barge bulwarks 26 are cut away, and bulwark plates 28 reinstalled between adjacent stanchions, except in the areas where the plates would interfere with standard deck fittings, vents, and so on. Limber holes or passages are provided as necessary. It is important that the spacing of the upper ends of the stanchions be precise. For this purpose, the upper end of each forward stanchion is connected to the lower end of the next aftward stanchion by a diagonal brace 30. The top of the aft-most stanchion, and every second stanchion forward therefrom, is connected to an adjacent stanchion by a longitudinally extending top beam 32.

Essentially the same construction is used for the inboard rows of stanchions. Diagonal braces 30 and longitudinal top beams 32 are provided at corresponding locations. In addition, for the two inboard rows, the upper portion of each stanchion is connected to the corresponding stanchion of the other inboard row by a transverse beam 34, and these beams support a center walkway of steel gratings 36, described below in more detail with reference to FIG. 9. The gratings are permanent, such that the two inboard rows of stanchions form a covered "tunnel" center zone which is not completely open at the top.

Figure 2:
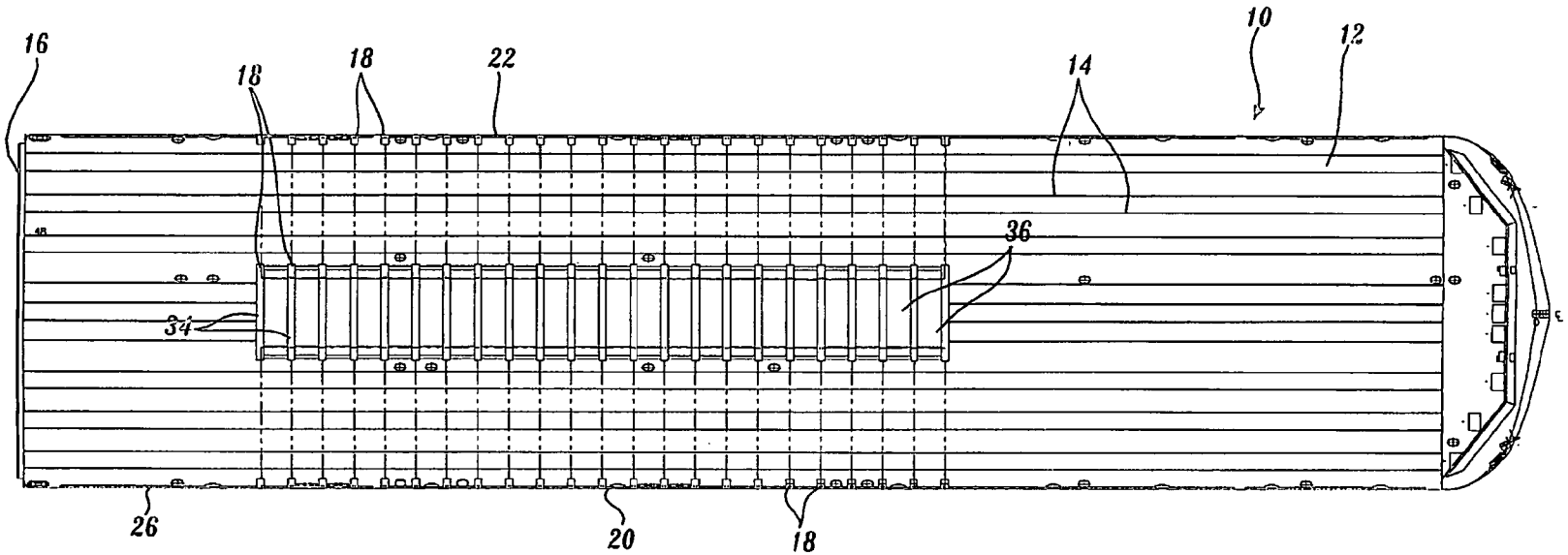
FIG. 2 is a diagrammatic top plan thereof.

With reference to FIG. 2, the spacing from each outboard row of stanchions to the adjacent inboard row is the same at both sides of the vessel and, in the preferred embodiment, sufficient to accommodate three sets of railroad tracks therebetween. The inboard rows of stanchions are closer together, sufficient to accommodate two rows of rail cars in the center tunnel zone.

Figures 5, 6, 7, 8:
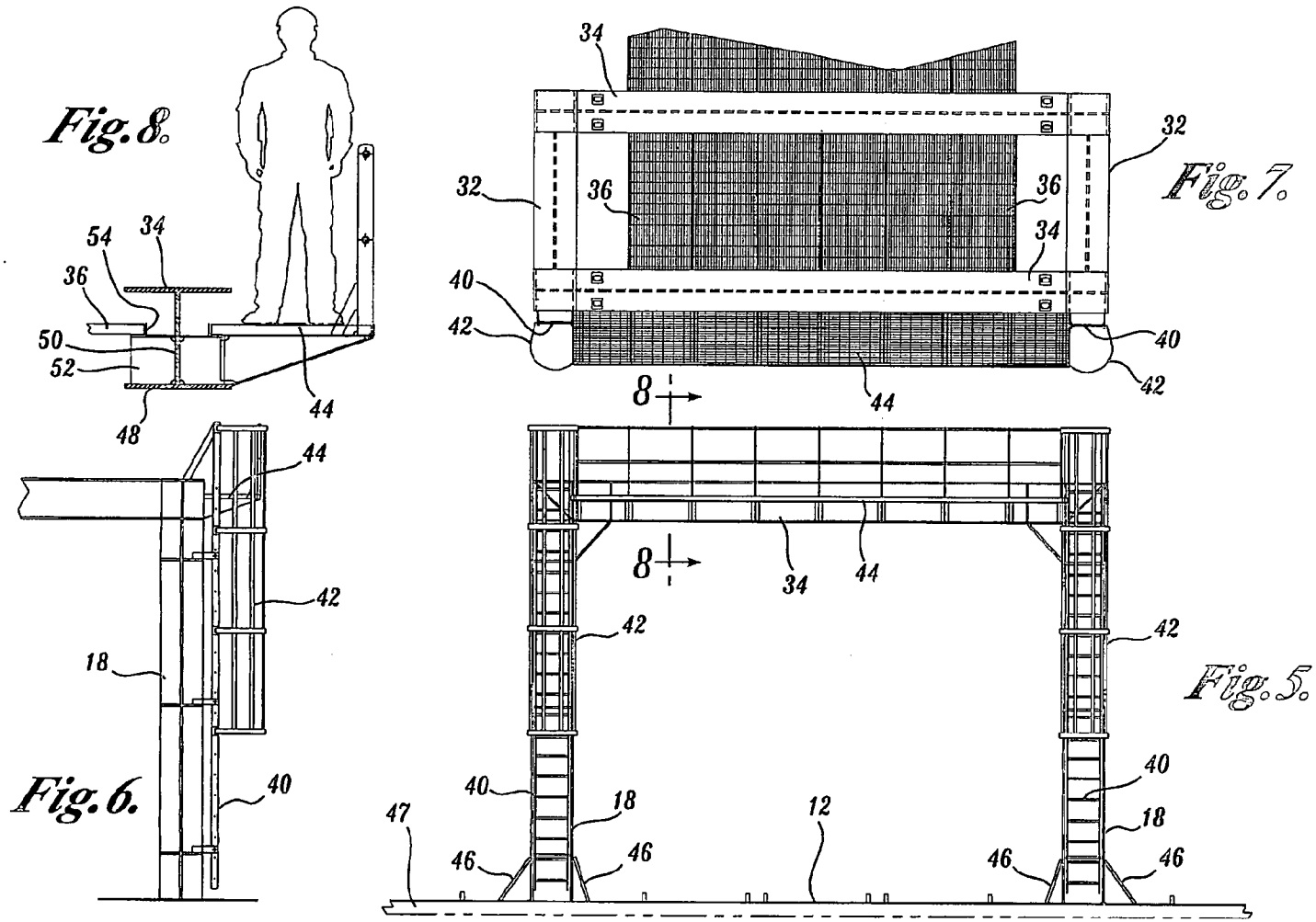
FIG. 5 is a further enlarged, fragmentary end elevation of a central part of a barge construction in accordance with the present invention, showing additional detail.
FIG. 6 is a fragmentary side elevation of the central part shown in FIG. 5.
FIG. 7 is a fragmentary top plan thereof.
FIG. 8 is an enlarged, diagrammatic, fragmentary section along line 8—8 of FIG. 5.

Access to the center grating walkway is provided at each corner of the tunnel zone, as shown in FIGS. 5–7 (these features are not shown in FIGS. 1–4). FIGS. 5–7 show the aft end, but the construction at the forward end is the same. An access ladder 40 with safety cage 42 is provided on each corner stanchion 18, with a cantilever end walkway 44 in the form of a steel grating supported from the end crossbeam 34 (the walkway 44 is also seen in the sectional view of FIG. 8). As also seen in FIG. 5, the bottom portions of the stanchions 18 can be supported by angle flanges 46 if necessary to spread the load more evenly to the deck understructure 47.

Figure 9:
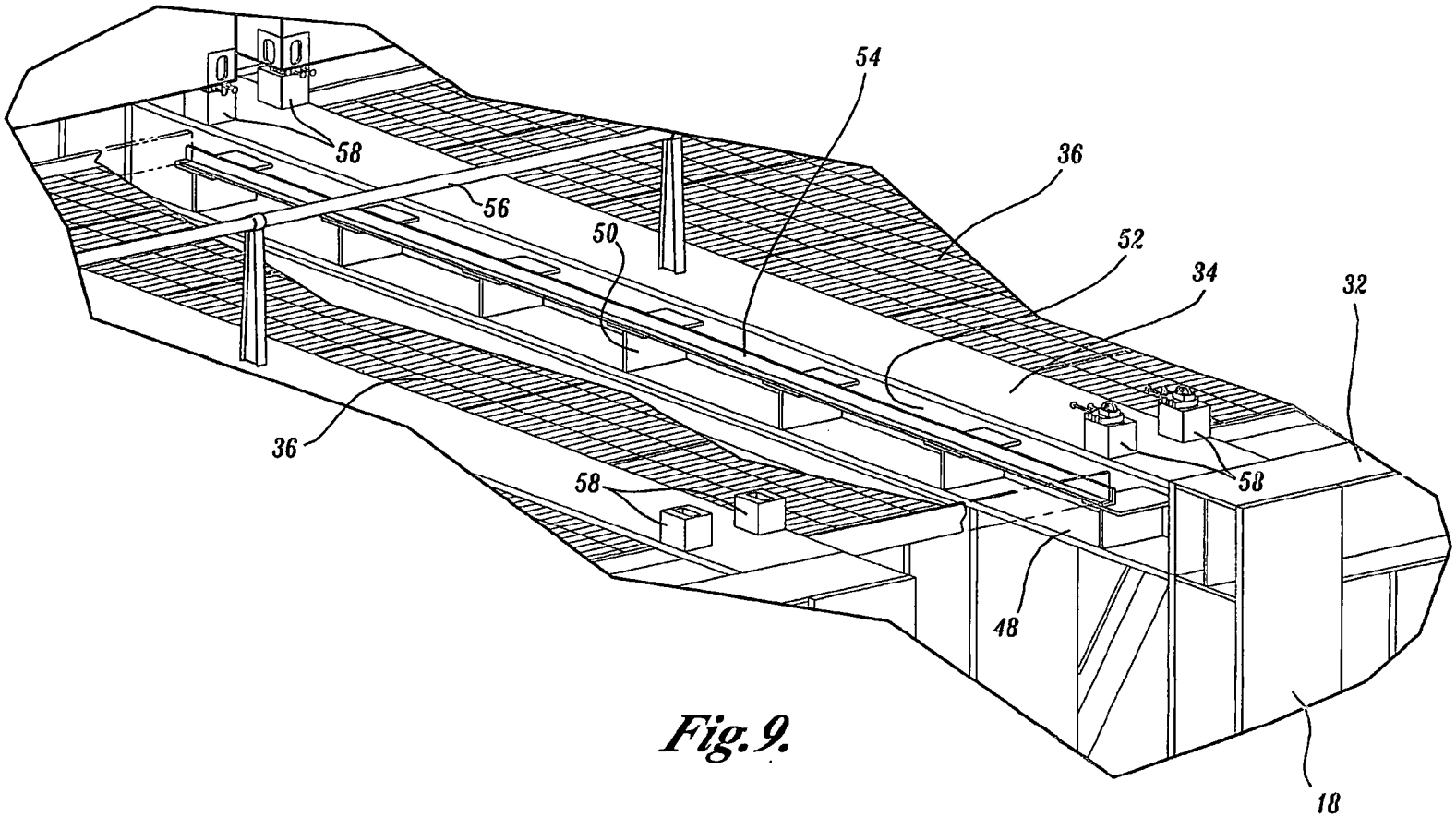
FIG. 9 is a further enlarged, diagrammatic, fragmentary top perspective of such central part, showing additional detail.

Additional details of the center walkway gratings 36 are best seen in FIG. 9. The transverse beams 34 are of I cross-section with bottom flanges 48. T-shaped support brackets 50 are welded to the upper surfaces of the bottom flanges 48 and the center vertical webs 52 at equally spaced locations along each beam 34. An angle iron 54 extends lengthwise of the beam, approximately midway between its top and bottom flanges, and is welded to the brackets 50. Elongated steel gratings 36 are fitted side-by-side with their opposite end portions on the shoulders formed by the angle irons 54. Preferably the T-brackets 50 are aligned with the joints between adjacent gratings, and all components are welded in position. As also seen in FIG. 9, a raised safety railing 56 can be provided along the centerline of the tunnel section.

Figure 4:
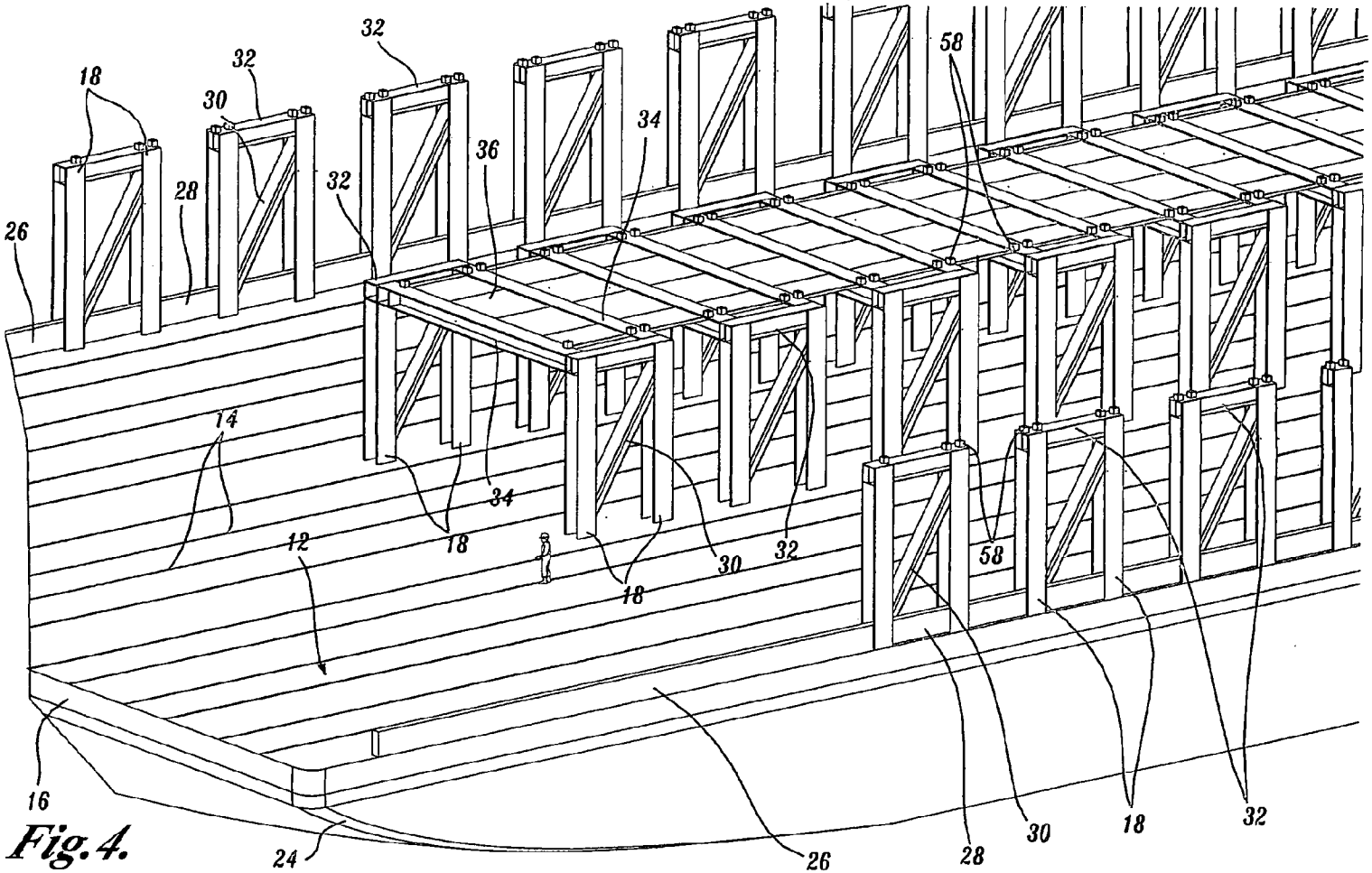
FIG. 4 is an enlarged, fragmentary top perspective of a barge construction in accordance with the present invention.

With reference to FIG. 4 and FIG. 9, freight container foundation blocks 58 are welded to the inboard and outboard stanchion structures at precise locations corresponding to uniform distances between lifting and stacking fittings of standard freight containers. A representative foundation is a model "TF-11" MacGregor Conver foundation available from Pacific Marine and Industrial of Novato, Calif. For example, stacking and lifting fittings on standard 40 foot (12.2 meter) containers and freight platforms ("flats") are corner inserts having downward opening sockets at the bottom corners and upward opening sockets at the top corners, spaced 40 feet (12.2 meters) apart lengthwise of the container and 8 feet, 7 inches (2.6 meters) apart transversely of the container. Longer containers, such as 53 foot (16.2 meter) containers, have stacking and lifting fittings at the same uniform locations, although not at the corners. The foundations 58 used in the present invention have upward opening sockets positioned to register with the sockets of the standard freight containers and freight platforms. Thus, the distance between the foundation 58 mounted on an aft, outboard stanchion and the corresponding inboard foundation is 40 feet (12.2 meters), with sufficient room being provided in the inboard tunnel structure for an overhang of a longer container. At the outboard side, a longer container will simply overhang the outboard side of the barge.

Figure 10:
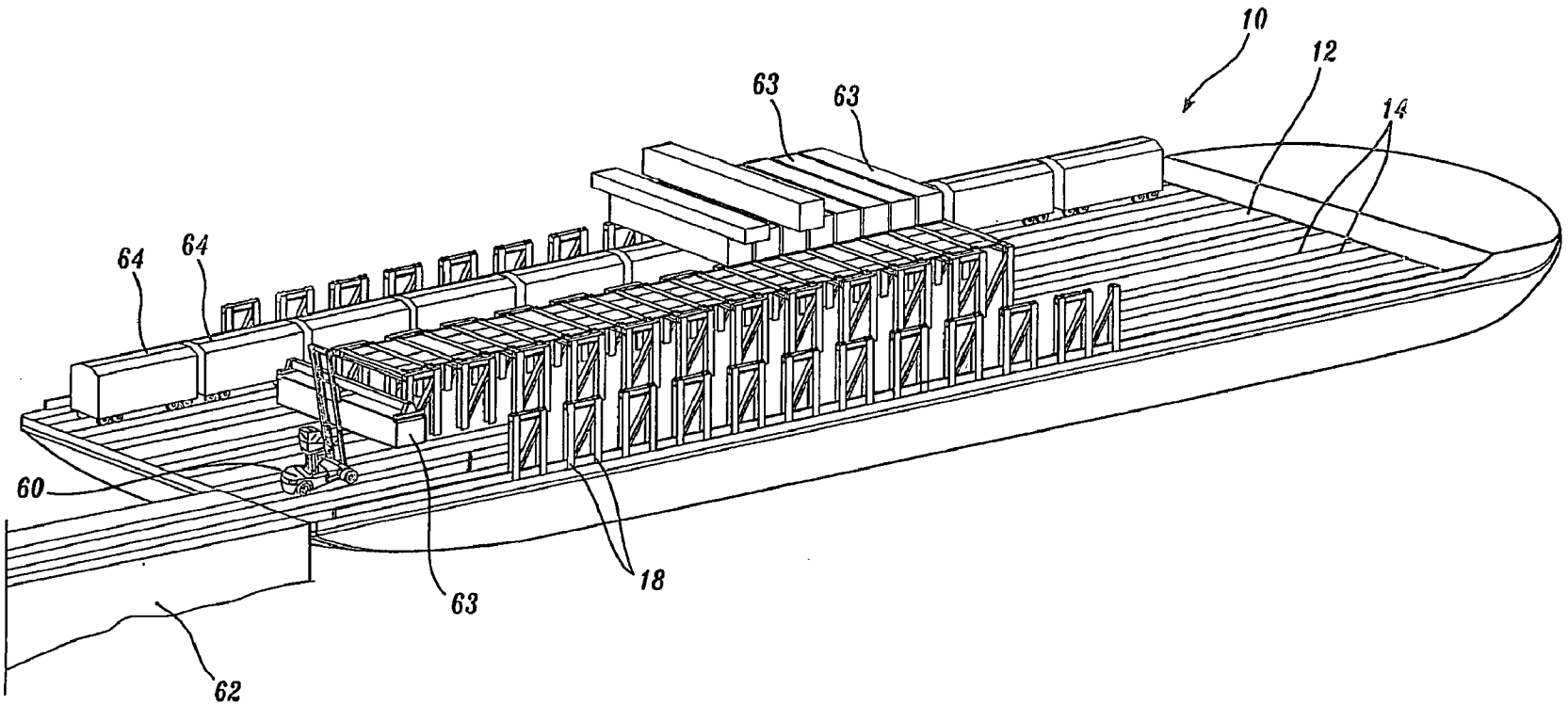
FIG. 10 is a diagrammatic top perspective of a barge construction in accordance with the present invention illustrating loading of freight onto a barge.
Figure 11:
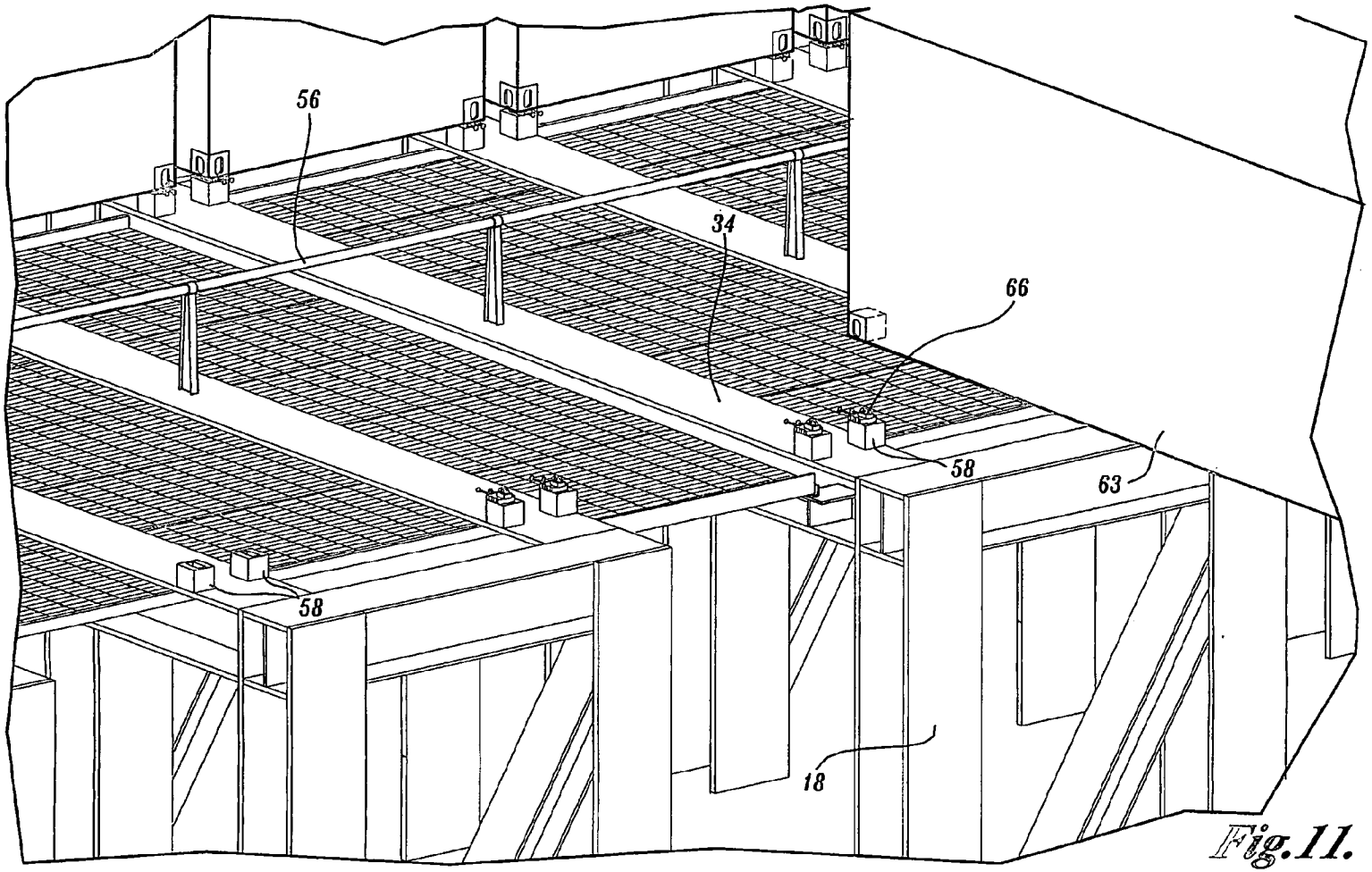
FIG. 11 is an enlarged, diagrammatic, fragmentary top perspective illustrating additional detail in the freight-loading process.

With reference to FIG. 10 and FIG. 11, the present invention allows great flexibility in the cargo to be transported by the barge, and convenience in loading and unloading the cargo. In most cases, the combination will include cargo in standard freight containers 63 or on freight platforms of 40 feet (12.2 meters) or longer. The containers can be loaded in the transversely extending orientation by a conventional forklift 60 using the same end ramp 62 that normally is used for loading rail cars 64. The forklift can travel lengthwise along one of the outboard loading zones to the far end of the rack structure, after raising the container to clear the highest parts of the rack structure, namely, the end walkways from the inboard corner ladders. The first such container can be placed at the forwardmost location. Preferably, semiautomatic twist locks are used for the outboard foundations such that the outboard corners of the container are automatically lashed by placement over the foundations and transverse shifting. The inboard foundations and twist locks 66 or cones are accessible to a worker standing on the center gratings. Suitable outboard twist locks are model "AFC-1L" and suitable inboard twist locks are model "CV-20/DUAL/2" twist locks, both available from Pacific Marine and Industrial of Novato, Calif.

Figure 3:
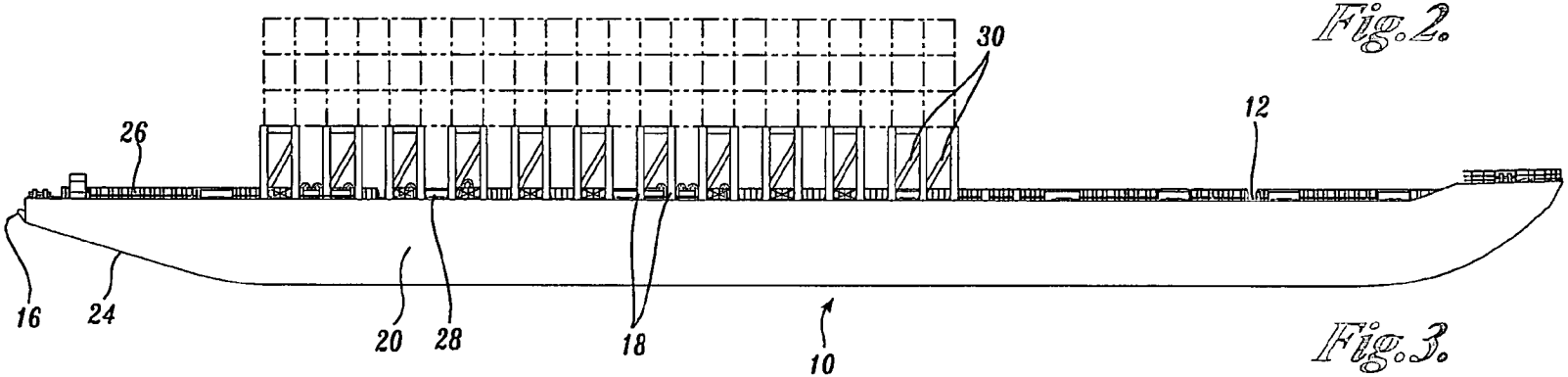
FIG. 3 is a diagrammatic side elevation thereof.

Working from the forward end of an outboard loading zone, containers can be placed across the zone and also can be stacked in tiers, using the same latching mechanism, namely, semiautomatic twist locks on the outboard ends and dual twist locks on the inboard ends. Standardized freight platforms ("flats") can be used on the top tier. The particular twist locks used may allow the containers to be loaded and lashed without other lashing apparatus, eliminating the need for catwalks or other manners of end access at the outboard side. In the rack construction having 23 stanchions in each row, 22 container locations are provided at each side, as indicated diagrammatically in broken lines in FIGS. 2 and 3. As represented in FIG. 3, containers can be stacked at each location. Only a single loading ramp is required, with no dockside or onboard lifting or hoisting apparatus such as container cranes.

When the desired containers have been mounted in one of the outboard zones, the rail cars for that zone can be loaded. Containers at the other outboard loading zone are positioned and lashed by the twist lock and stacking mechanism prior to loading rail cars in that zone.

Cargo too wide to fit between the outboard loading zones of the rack structure can be carried on the forward or aft area of the deck. Tall cargo can be carried at the same areas, or in one of the outboard loading zones, either between containers on the rack system or in an outboard zone that does not have any overhead containers. Tall cargo also can be loaded by movement through an outboard zone prior to loading of containers.

Occasionally difficulties may arise in mounting or, particularly, uncoupling or unlashing a container. The open construction of the rack structure permits access to the underside of the lowest tier of containers at both the outboard and inboard ends. As seen in FIG. 11, preferably the center walkway gratings 36 are spaced inward from the foundation blocks 58 slightly, and the inboard blocks 58 are mounted on the crossbeams 34 at locations spaced inward from the adjacent stanchions 18. Thus, there is open access to the inboard end portion of the bottom tier of containers as well as to the outboard end portions from below. Since the gratings 36 are lowered relative to the top flanges of the crossbeams 34, there also is some room for a worker to access a twist lock or cone, for example, by lying on the grating and reaching under a container.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A freight hauling vessel comprising:

an understructure;

an elongated deck supported on the understructure and adapted for wheeled cargo to be rolled onto the deck, lengthwise thereof, at an origin location and rolled off of the deck, lengthwise thereof, at a destination location;

at least two rows of upright stanchions, each row extending lengthwise of the deck, the rows being spaced apart transversely of the deck with the space between the rows being open and unobstructed at the top, the stanchions being constructed and arranged relatively for supporting freight spanning between the rows, above the deck, with sufficient room thereunder for wheeled cargo to be rolled beneath the freight; and container foundation blocks supported on the upper ends of the stanchions, the blocks being spaced apart transversely and longitudinally of the vessel at standard distances corresponding to the distances between fittings of standardized freight containers.

2. The vessel defined in claim 1, in which the stanchions are permanently affixed to and supported by the understructure.

3. The vessel defined in claim 1, in which the foundation blocks of the different rows are positioned essentially 40 feet (12.2 meters) apart, and foundation blocks of each row being spaced apart, essentially 8 feet, 7 inches (2.6 meters) to match the distances between fittings of standardized freight containers.

4. The vessel defined in claim 1, including twist locks or stacking cones received in the foundation blocks, and an elongated standardized freight container having its length extending transversely between the rows of stanchions and having stacking fittings secured by the twist locks or stacking cones.

5. The vessel defined in claim 1, including a first outboard row of stanchions along one outboard side of the vessel, a second row of outboard stanchions along the other outboard side of the vessel, two inboard rows of stanchions spaced transversely apart toward the center portion of the vessel, the inboard stanchions being connected together by crossbeams, and the deck having at least one set of railroad tracks between each row of outboard stanchions and an adjacent inboard row of stanchions, the spaces between the outboard rows of stanchions and the adjacent inboard rows of stanchions being open and unobstructed.

6. The vessel defined in claim 5, including at least one set of railroad tracks extending between the inboard rows of stanchions.

7. The vessel defined in claim 5, including rail cars supported on the railroad tracks between each outboard row of stanchions and an adjacent inboard row of stanchions, and elongated standardized freight containers spanning between the outboard rows of stanchions and the inboard rows of stanchions over the rail cars.

8. The vessel defined in claim 5, including steel gratings supported on the crossbeams and forming a walkway between the two inboard rows of stanchions.

9. The vessel defined in claim 8, in which the steel gratings are spaced below top surfaces of the crossbeams.

10. The vessel defined in claim 5, including freight container foundation blocks mounted on or adjacent to each of the rows of stanchions, at locations corresponding to standard distances between standard freight container fittings.

11. The method of loading freight onto a vessel which comprises:

loading a standardized freight container onto a permanent rack structure projecting vertically from the deck of the vessel, such rack structure including at least two rows of support members spaced apart with the space between the rows open and unobstructed, such that opposite ends of the standardized container rest on support members of the different rows and the container spans between the different rows; and thereafter rolling wheeled cargo onto the deck beneath the freight containers.

12. The method defined in claim 11 including loading the container onto the rack structure by a lift truck that transports the container through the open air space between the rows prior to lowering the container onto the support members.

13. The method defined in claim 11, in which the deck has railroad tracks extending lengthwise between the rows and the wheeled cargo includes rail cars rolled onto the deck from a ramp and then lengthwise of the deck between the rows and beneath the freight container.

* * * * *

UNITED STATES PATENT AND TRADEMARK OFFICE

CERTIFICATE OF CORRECTION

PATENT NO. : 7,093,550 B2
APPLICATION NO. : 10/506205
DATED : August 22, 2006
INVENTOR(S) : G. Williamson et al.

It is certified that error appears in the above-identified patent and that said Letters Patent is hereby corrected as shown below:

| COLUMN | LINE | |
|---|---|---|
| Title Page, Item (56) | Refs. Cited, Foreign Pats., Item 2 | delete as duplicative "GB 2040831 A 9/1980" |
| Title Page, Item (56) | Refs. Cited, Foreign Pats., Item 6 | delete as duplicative "SU 1474053 A 4/1989" |
| Title Page, Item (57) | Abstract LN. 5 of text | "betwe" should read --between-- |

Signed and Sealed this

Twenty-fourth Day of April, 2007

JON W. DUDAS
*Director of the United States Patent and Trademark Office*